US009968805B2

(12) United States Patent
Chang

(10) Patent No.: US 9,968,805 B2
(45) Date of Patent: May 15, 2018

(54) DOOR BREACHING SYSTEM AND METHOD

(71) Applicant: Luke Chang, Milwaukee, WI (US)

(72) Inventor: Luke Chang, Milwaukee, WI (US)

( * ) Notice: Subject to any disclaimer, the term of this patent is extended or adjusted under 35 U.S.C. 154(b) by 0 days. days.

(21) Appl. No.: 14/946,976

(22) Filed: Nov. 20, 2015

(65) Prior Publication Data

US 2017/0143998 A1 May 25, 2017

(51) Int. Cl.
*B66C 1/12* (2006.01)
*A62B 3/00* (2006.01)

(52) U.S. Cl.
CPC ..... *A62B 3/005* (2013.01)

(58) Field of Classification Search
CPC B63C 11/50; B66C 1/18; F21V 21/38; F16M 13/00; A01K 1/04; A45F 3/14; A45F 3/04; A45F 3/02; A01D 46/22; A62B 3/005
See application file for complete search history.

(56) References Cited

U.S. PATENT DOCUMENTS 4,032,102 A * 6/1977 Wolf ..... A47G 7/047 248/301
4,529,240 A * 7/1985 Engel ..... A22B 5/161 24/129 R
5,852,988 A * 12/1998 Gish ..... A01K 27/003 119/795
5,967,481 A * 10/1999 Lobo ..... F21S 2/00 248/323
6,626,132 B1 * 9/2003 Mann ..... A01K 27/003 119/769
7,905,527 B1 * 3/2011 Smallin ..... B66C 1/16 294/66.1
8,544,912 B1 * 10/2013 Matthews ..... B66C 1/12 294/74

* cited by examiner

*Primary Examiner* — Stephen Vu

(74) *Attorney, Agent, or Firm* — Absolute Technology Law Group, LLC

(57) ABSTRACT

The door breaching system is capable of removing or opening a door attached to a structure. A main tether made up of a tether strap and multiple eyelets attaches to a vehicle through one of the eyelets at one end of the tether strap. The other end of the tether strap attaches to at least one hook strap through a master link. Each hook strap has a hook at a distal end. In use, at least one sling loops through part of the door. Sling eyelets on either end of a sling strap connect to the hook. Due to the secure connection between the door and the door breaching system, moving the vehicle away from the structure removes the door in a controllable fashion.

19 Claims, 5 Drawing Sheets

DOOR BREACHING SYSTEM AND METHOD

BACKGROUND OF THE INVENTION

1. Field of Invention

This invention relates to the field of land vehicles and more specifically to a device attached to an exterior of a vehicle for breaching a door.

2. Description of Related Art

Door breaching is a process used by military and law enforcement to force open locked doors. Door breaching processes include thermal, ballistic and explosive methods to open doors. Door breaching processes may also utilize mechanical devices, such as pry bars or rams, which pry or knock open doors to allow military and law enforcement personnel to enter a building.

In many cases, portable mechanical devices are carried to a door, and then swung at the door by hand. Other mechanical devices pry doors off hinges or out of frames. Use of these manual devices exposes personnel to danger from gunfire or other physical attacks from within the building. Furthermore, the force used to open the door is entirely reliant on the strength of personnel holding the device. Reinforced security doors can take numerous attempts to open, increasing exposure time and fatiguing personnel.

One prior art device that attempts to solve these problems is a ram attached to a tactical vehicle. When a driver accelerates their vehicle towards a building, the ram pushes the door in. While this reduces personnel exposure to danger and utilizes vehicular power, the resultant door wreckage may cause personnel entering the building to lose their footing. Moreover, once the ram has pushed in the door, it requires time to withdraw to allow personnel access to the opening. Another vehicle-mounted device "harpoons" the door and pulls it free from the building. These devices are expensive, difficult to operate and may cause injury if not properly aimed.

There is an unmet need in the art for a vehicle-mounted door breaching system that separates doors from buildings in a controlled technique.

BRIEF SUMMARY OF THE INVENTION

The present invention is a door breaching system including a main tether having a tether strap and a plurality of tether eyelets. A master link connecting a distal end of the main tether to a proximal end of at least one hook strap. At least one hook connects to a distal end of the hook strap. At least one sling connects to the hook. The sling includes a sling strap and a plurality of sling eyelets located on either end of the sling strap.

BRIEF DESCRIPTION OF SEVERAL VIEWS OF THE DRAWING(S)

FIG. 1*a* illustrates a side view of an exemplary embodiment of a door breaching system.

FIGS. 1*b* and 1*c* illustrate front and side views of an exemplary embodiment of a door breaching system in use.

TERMS OF ART

As used herein, the term "distal" means a location situated away from a central point.

As used herein, the term "proximal" means a location situated nearer to a central point.

DETAILED DESCRIPTION OF THE INVENTION

Figure 1A:
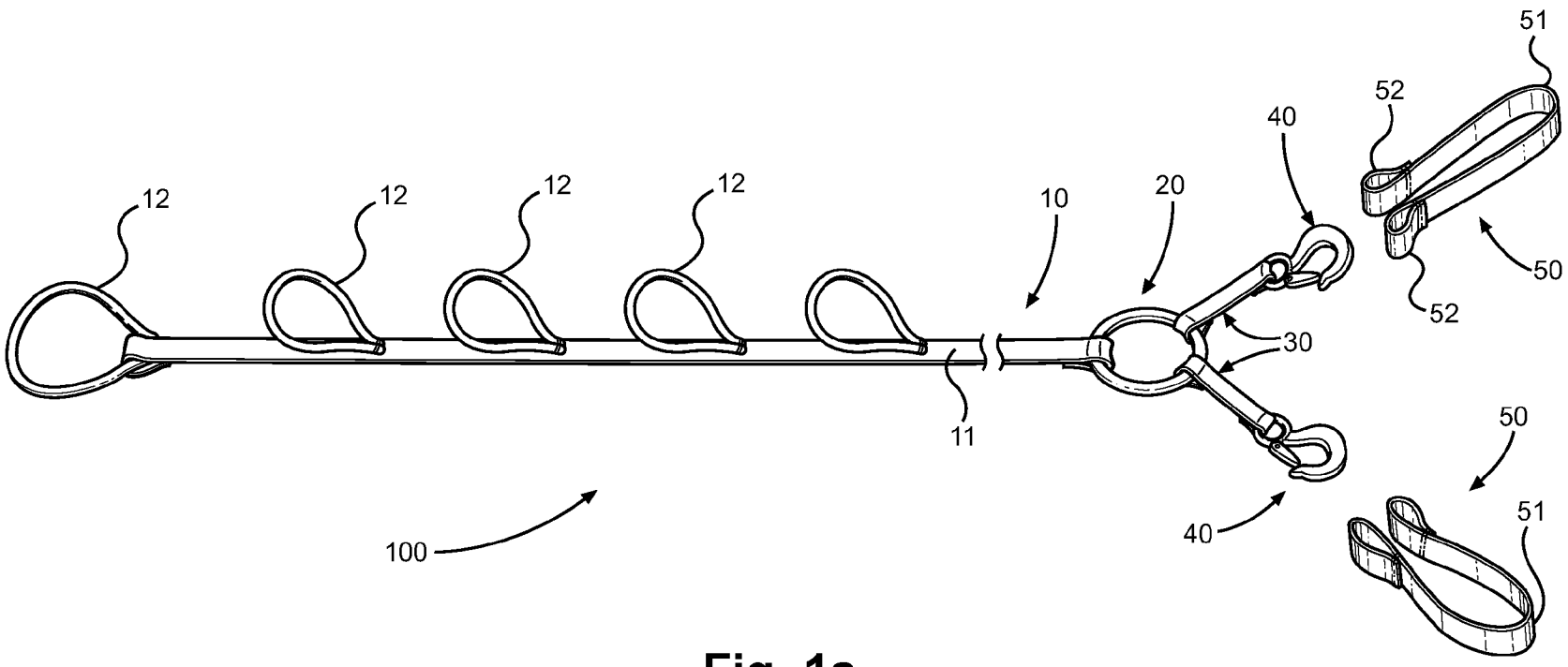
Figure 1B:
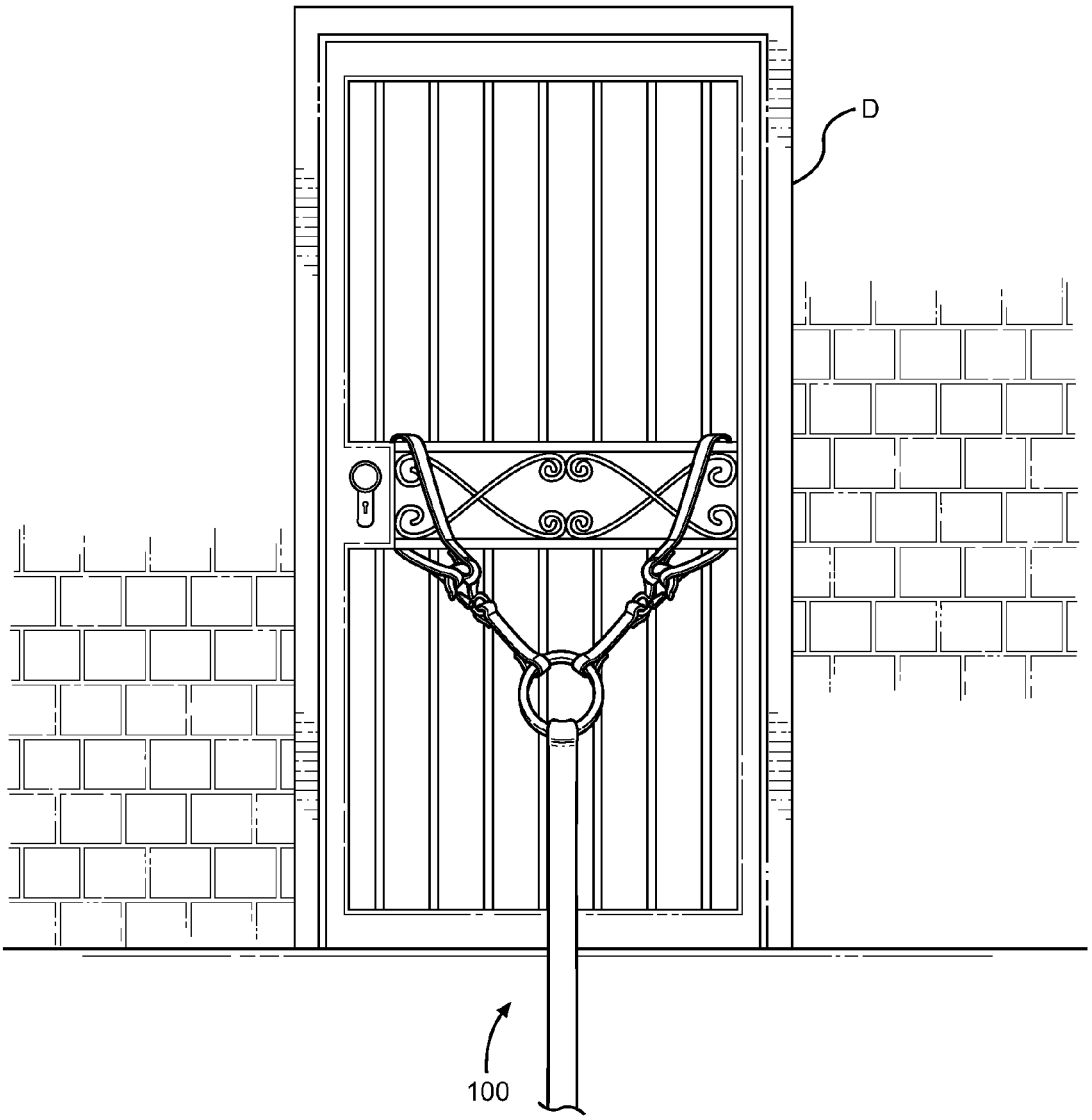
Figure 1C:
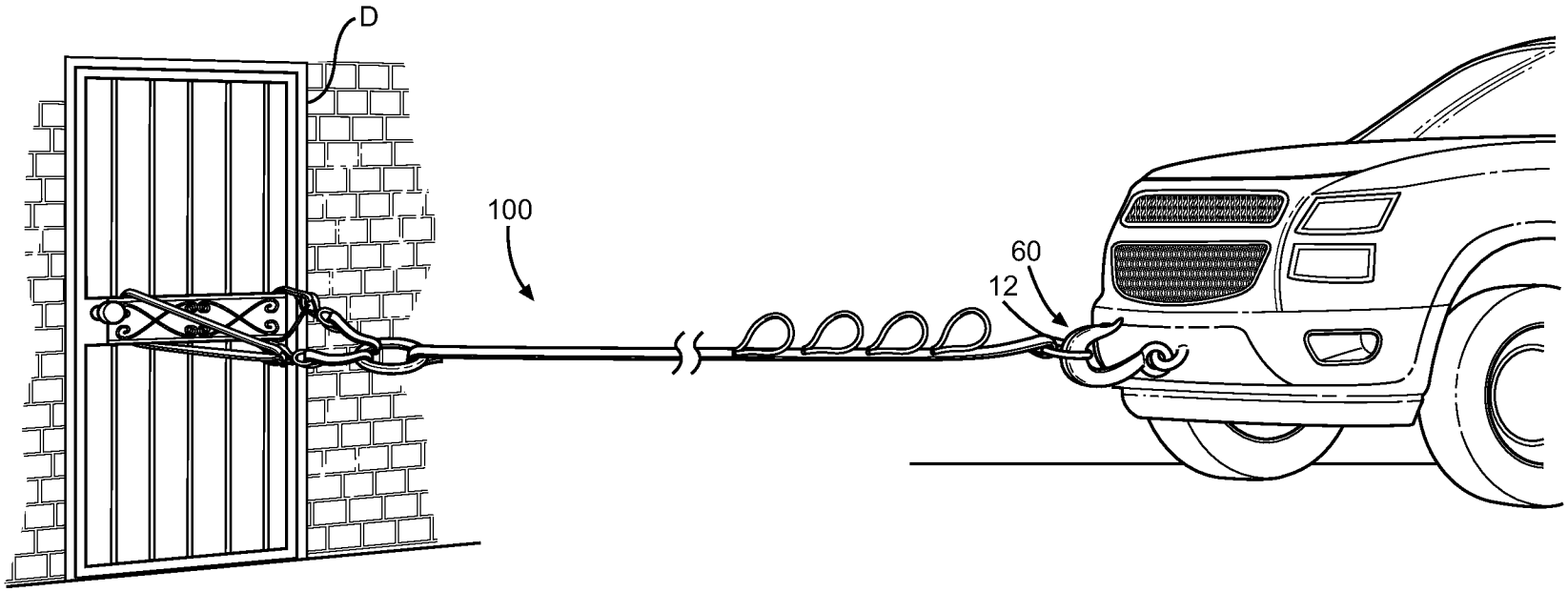

FIG. 1*a* illustrates a side view of an exemplary embodiment of a door breaching system 100. FIGS. 1*b* and 1*c* illustrate front and side views of an exemplary embodiment of door breaching system 100 in use. Door breaching system 100 includes main tether 10, master link 20, at least one hook strap 30, at least one hook 40, at least one sling 50, and a vehicle anchor 60.

Main tether 10 includes tether strap 11 and a plurality of tether eyelets 12. Tether strap 11 is approximately 1 foot to approximately 100 feet long, approximately 1 inch to approximately 3 inches wide and approximately 0.25 inches to approximately 0.5 inches thick. In the exemplary embodiment, tether strap 11 is a woven polymer such as, but not limited to nylon. In one embodiment, tether strap 11 is green treated nylon sling web. Tether strap 11 has a break strength of at least approximately 16,000 lbs. with a minimum 5,000 lbs. working load limit.

In the exemplary embodiment, ten tether eyelets 12 are located on a proximal section of tether strap 11, spaced apart approximately 5 feet. In other embodiments, the number of tether eyelets 12 ranges from approximately 5 to approximately 20, while the spacing from approximately 5 feet to approximately 10 feet. In the exemplary embodiment, tether eyelets 12 are loops manufactured from a woven polymer such as, but not limited to nylon. In one embodiment, tether eyelets 12 are green treated nylon sling web. Tether eyelets 12 have an inner diameter ranging from approximately 8 inches to approximately 12 inches.

Master link 20 connects a distal end of main tether 10 to proximal ends of hook straps 30. In the exemplary embodiment, master link 20 is a welded steel ring with a thickness of approximately 0.5 inches. In other embodiments, master link 20 is a metallic alloy oblong hook or a metallic alloy oblong ring. In certain embodiments, master link 20 has dimensions of approximately 2.5 inches wide by 5 inches long, with a thickness of 0.5 inches.

Hook straps 30 interconnect master link 20 and sling hooks 40. The exemplary embodiment of FIG. 1 includes two hook straps 30, but other embodiments may include between approximately 1 and approximately 6 hook straps 30. Each hook strap 30 is approximately 12 inches to approximately 72 inches long, approximately 1 inch to approximately 3 inches wide and approximately 0.25 inches to approximately 0.75 inches thick. In the exemplary embodiment, hook straps 30 are a woven polymer such as, but not limited to nylon. In one embodiment, hook straps 30 are green treated nylon sling web.

Hooks 40 interconnect distal ends of hook straps 30 and slings 50. The exemplary embodiment of FIG. 1 includes two hooks 40, but other embodiments may include between approximately 1 and approximately 12 hooks 40. In the exemplary embodiment, hooks 40 are steel eye sling hooks with a self-closing latch. In one embodiment, hooks 40 are steel eye sling hooks with a thickness of 9/32 of an inch and a spring operated latch. Other embodiments of hooks 40 may include sorting hooks, oblong hooks, clevis sling hooks, clevis grab hooks, clevis foundry hooks and eye grab hooks, with or without a self-closing or manually closing latch.

Slings 50 loop around portions of a door, connecting the door to door breaching system 100. The exemplary embodiment of FIG. 1 includes two slings 50, but other embodiments may include between 1 and 6 slings 50. Each sling 50 includes a sling strap 51 and a plurality of sling eyelets 52. Sling strap 51 is approximately 3 feet to approximately 6 feet long, approximately 1 inch to approximately 3 inches wide and approximately 0.25 inches to approximately 0.75 inches thick. In the exemplary embodiment, sling strap 51 is a woven polymer such as, but not limited to nylon. In one embodiment, sling strap 51 is green treated nylon sling web. Sling strap 51 has a break strength of at least approximately 16,000 lbs. with a minimum 5,000 lbs. working load limit Sling eyelets 52 are located on each end of sling strap 51. In the exemplary embodiment, sling eyelets 52 are loops manufactured from a woven polymer such as, but not limited to nylon. In one embodiment, sling eyelets 52 are green treated nylon sling web. Sling eyelets 52 have an inner diameter ranging from approximately 12 inches to approximately 18 inches.

Vehicle anchor 60 provides a connection between a vehicle and door breaching system 100. At least one tether eyelet 12 connects to vehicle anchor 60. Vehicle anchor 60 is made from hardened steel. In one embodiment, vehicle anchor 60 is a hook attached to a vehicle bumper. Another embodiment of vehicle anchor 60 is a post welded to a vehicle bumper.

Figure 2:
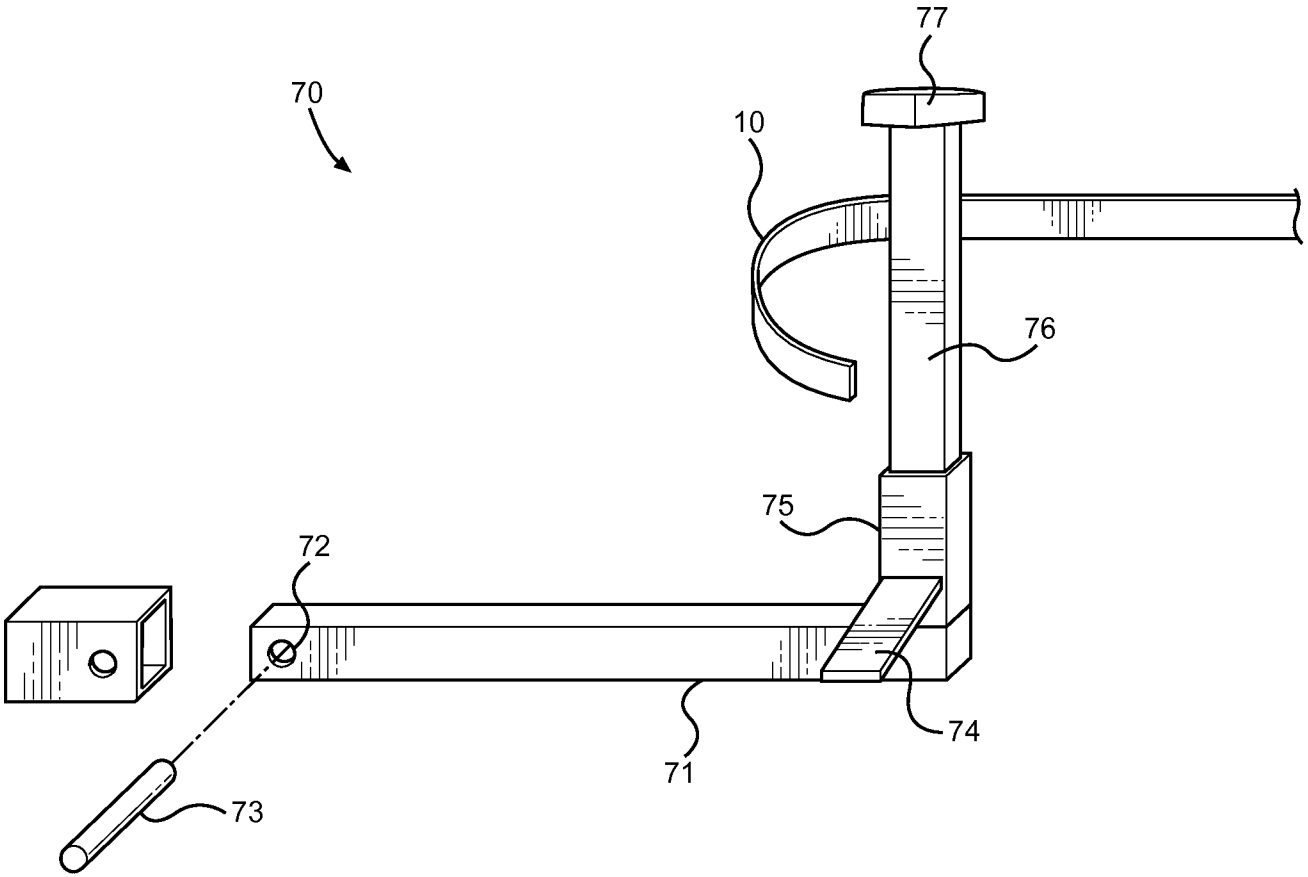
FIG. 2 illustrates a side view of an exemplary embodiment of an optional vehicle pivot.

FIG. 2 shows a side view of an exemplary embodiment of optional vehicle pivot 70. In the exemplary embodiment, vehicle pivot 70 includes a hitch assembly bar 71 with hitch pin apertures 72 that receive a hitch pin 73 to attach hitch assembly bar 71 to a vehicle's trailer hitch receiver. In the exemplary embodiment, hitch assembly bar 71 is made from hollow or solid steel, with a square cross-section, and has a length ranging from approximately 18 inches to approximately 36 inches. Reinforced gussets 74 on either side of hitch assembly bar 71 connect hitch assembly bar 71 to a post sleeve 75. In the exemplary embodiment, post sleeve 75 is made from hollow steel, with a square or circular cross-section, a length ranging from approximately 6 inches to approximately 12 inches and an inner diameter ranging from approximately 1.5 inches to approximately 4 inches.

Post sleeve 75 receives a first end of a removable vertical post 76. Vertical post 76 is made from solid or hollow steel, with a square or circular cross-section, a length ranging from approximately 3 inches to approximately 8 inches and an outer diameter ranging from approximately 1.5 inches to approximately 4 inches. An integral end cap 77 at a second end of vertical post 76 prevents main tether 10 from sliding off vertical post 76. End cap 77 is made from steel plating having a thickness of approximately 0.25 inches and a diameter ranging from approximately 4 inches to approximately 12 inches.

In use, vehicle pivot 70 attaches to a second vehicle. Main tether 10 extends around vehicle pivot 70 between the door and vehicle anchor 60. This permits the first vehicle to remove the door at an angle if, for example, there is insufficient space to safely remove the door.

Figure 3:
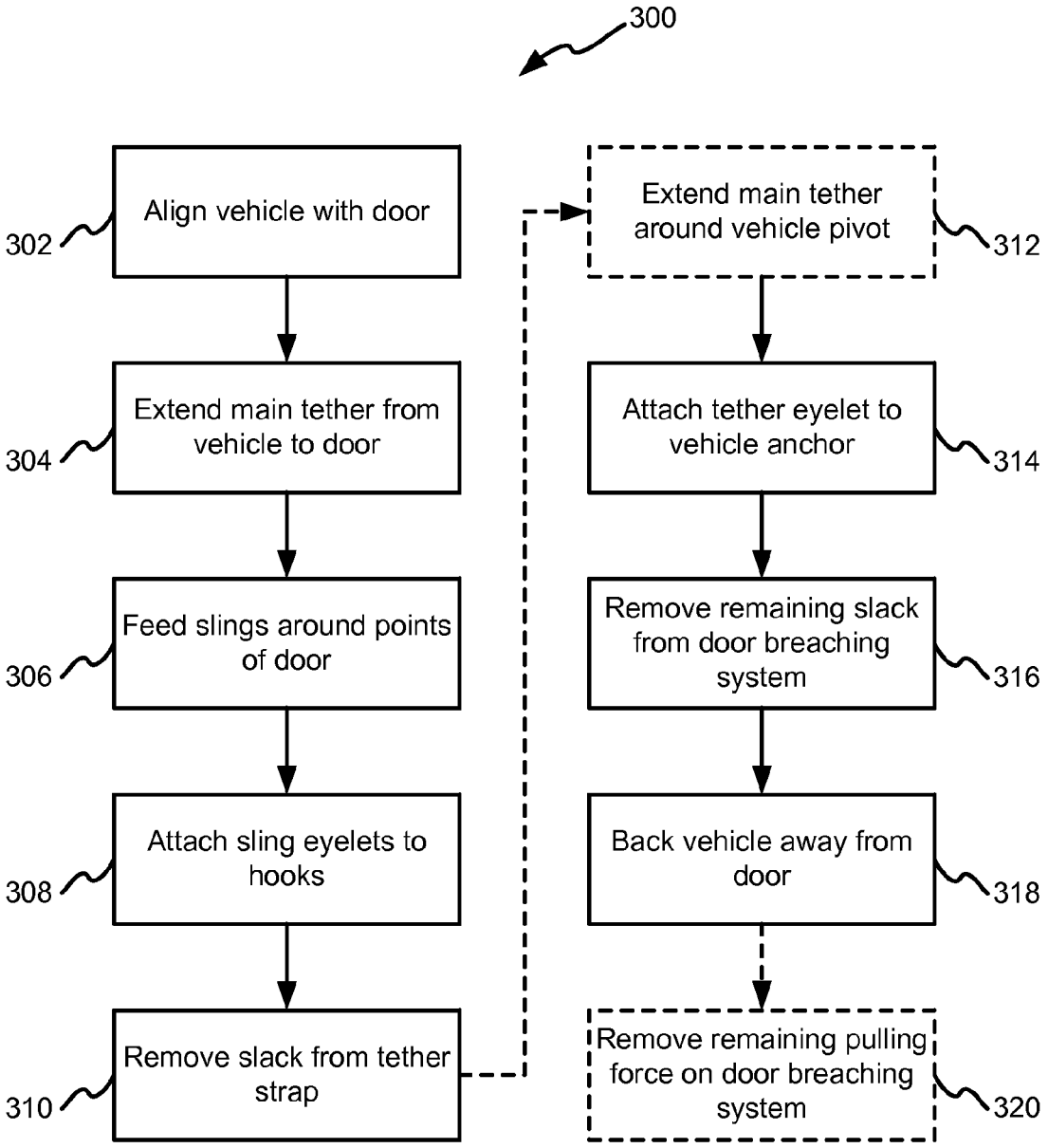
FIG. 3 illustrates a flowchart of a method for using a door breaching system.

FIG. 3 illustrates a flowchart of a method 300 for using door breaching system 100.

In step 302, method 300 aligns a vehicle to face directly in front or to the side of a door.

In step 304, method 300 extends main tether 10 from the vehicle to the door.

In step 306, method 300 feeds slings 50 around at least two separate and substantial points of the door such as the frame, main reinforced cross section or security bars.

In step 308, method 300 attaches sling eyelets 52 to hooks 40. Only one sling 50 attaches to each hook 40.

In step 310, method 300 removes slack from tether strap 12 by pulling it taut.

In optional step 312, method 300 passes main tether 10 around vehicle pivot 70.

In step 314, method 300 attaches one of tether eyelets 12 to vehicle anchor 60 while keeping tether strap 12 as taut as possible.

In step 316, method 300 backs the vehicle away from the door to remove any remaining slack from door breaching system 100.

In step 318, method 300 backs the vehicle away from the door to transfer a pulling force from the vehicle to the door until the door is opened or removed from the structure.

In optional step 320, method 300 removes any remaining pulling force on door breaching system 100 by placing the vehicle in "Neutral" or slowly returning the vehicle to its original starting position.

It will be understood that many additional changes in the details, materials, procedures and arrangement of parts, which have been herein described and illustrated to explain the nature of the invention, may be made by those skilled in the art within the principle and scope of the invention as expressed in the appended claims.

It should be further understood that the drawings are not necessarily to scale; instead, emphasis has been placed upon illustrating the principles of the invention. Moreover, the terms "about," "substantially" or "approximately" as used herein may be applied to modify any quantitative representation that could permissibly vary without resulting in a change in the basic function to which it is related.

What is claimed is:

1. A door breaching system comprising:

a main tether comprising a tether strap and a plurality of tether eyelets, wherein said plurality of tether eyelets are located on a proximal section of said tether strap and spaced apart approximately 5 feet to approximately 10 feet, wherein said plurality of tether eyelets number from approximately 5 to approximately 20;

a master link connecting a distal end of said main tether to a proximal end of at least one hook strap;

at least one hook connected to a distal end of said at least one hook strap; and at least one sling connected to said at least one hook, wherein said at least one sling comprises a sling strap and a plurality of sling eyelets located on either end of said sling strap.

2. The system of claim 1, further comprising a vehicle anchor connected to at least one of said plurality of tether eyelets.

3. The system of claim 1, further comprising a vehicle pivot comprising a hitch assembly bar having a plurality of hitch pin apertures, a hitch pin and a hollow post sleeve receiving a first end of a removable vertical post, wherein said main tether contacts said vehicle pivot.

4. The system of claim 3, wherein a plurality of reinforced gussets connect said hitch assembly bar and said hollow post sleeve.

5. The system of claim 3, wherein said removable vertical post further comprises an integral end cap on a second end of said removable vertical post.

6. The system of claim 1, wherein said tether strap is approximately 1 foot to approximately 100 feet long, approximately 1 inch to approximately 3 inches wide and approximately 0.25 inches to approximately 0.5 inches thick.

7. The system of claim 1, wherein said tether strap comprises a woven material selected from the group consisting of: a polymer or a metal.

8. The system of claim 1, wherein said plurality of tether eyelets are loops comprising a woven material selected from the group consisting of: a polymer or a metal.

9. The system of claim 1, wherein said master link comprises a welded steel ring having a thickness of approximately 0.5 inches.

10. The system of claim 1, wherein said at least one hook strap numbers between approximately 1 and approximately 6.

11. The system of claim 1, wherein said at least one hook strap is approximately 12 inches to approximately 72 inches long, approximately 1 inch to approximately 3 inches wide and approximately 0.25 inches to approximately 0.75 inches thick.

12. The system of claim 1, wherein said at least one hook strap comprises a woven material selected from the group consisting of: a polymer or a metal.

13. The system of claim 1, wherein said at least one hook numbers between approximately 1 and approximately 12.

14. The system of claim 1, wherein said at least one hook comprises steel.

15. The system of claim 1, wherein said at least one hook is selected from the group consisting of: eye sling hooks, sorting hooks, oblong hooks, clevis sling hooks, clevis grab hooks, clevis foundry hooks and eye grab hooks.

16. The system of claim 1, wherein said at least one hook comprises a latch selected from the group consisting of: a self-closing latch and a manually closing latch.

17. The system of claim 1, wherein said at least one sling numbers between approximately 1 and approximately 6.

18. The system of claim 1, wherein said at least one sling comprises a woven material selected from the group consisting of: a polymer or a metal.

19. The system of claim 1, wherein said at least one sling strap is approximately 36 inches to approximately 72 inches long, approximately 1 inch to approximately 3 inches wide and approximately 0.25 inches to approximately 0.75 inches thick.

* * * * *